US009230702B2

(12) United States Patent
Liu et al.

(10) Patent No.: US 9,230,702 B2
(45) Date of Patent: Jan. 5, 2016

(54) SYSTEM AND METHOD FOR REDUCING GRID LINE IMAGE ARTIFACTS

(75) Inventors: James Zhengshe Liu, Salt Lake City, UT (US); Richard Larry Anderton, West Jordan, UT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 585 days.

(21) Appl. No.: 13/588,708

(22) Filed: Aug. 17, 2012

(65) Prior Publication Data

US 2014/0048713 A1 Feb. 20, 2014

(51) Int. Cl.
*G21K 1/02* (2006.01)
*G21K 1/10* (2006.01)

(52) U.S. Cl.
CPC *G21K 1/025* (2013.01); *G21K 1/10* (2013.01); *Y10T 29/49002* (2015.01)

(58) Field of Classification Search
CPC ..... G10T 1/20; G21K 1/025; G21K 1/10; A61B 6/06
See application file for complete search history.

(56) References Cited

U.S. PATENT DOCUMENTS

| | | | | |
|---|---|---|---|---|
| 5,666,395 | A * | 9/1997 | Tsukamoto et al. | 378/98.4 |
| 6,177,237 | B1 * | 1/2001 | Guida et al. | 430/320 |
| 8,172,461 | B2 | 5/2012 | Liu | |
| 2002/0003863 | A1 * | 1/2002 | Ohkoda | 378/154 |
| 2002/0070365 | A1 * | 6/2002 | Karellas | 250/581 |
| 2004/0156479 | A1 * | 8/2004 | Hoheisel et al. | 378/154 |
| 2008/0088059 | A1 * | 4/2008 | Tang et al. | 264/261 |
| 2011/0248174 | A1 * | 10/2011 | O'Connor et al. | 250/363.1 |

FOREIGN PATENT DOCUMENTS

JP 2011050736 A 3/2011

* cited by examiner

*Primary Examiner* — Casey Bryant
(74) *Attorney, Agent, or Firm* — Fletcher Yoder, P.C.

(57) ABSTRACT

An imaging system includes a detector configured to detect X-rays from an X-ray source. The detector includes multiple photodetector elements. The imaging system also includes an anti-scatter grid disposed over the detector, wherein the anti-scatter grid includes multiple radiation absorbing elements. At least a portion of one or more of the radiation absorbing elements of the multiple radiation absorbing elements is disposed on each photodetector element, and a total area of each respective portion of the one or more radiation absorbing elements disposed on each photodetector element is substantially equal.

23 Claims, 3 Drawing Sheets

SYSTEM AND METHOD FOR REDUCING GRID LINE IMAGE ARTIFACTS

BACKGROUND

The subject matter disclosed herein relates generally to X-ray imaging systems, and more particularly to anti-scatter grids for reducing grid line image artifacts in X-ray images generated using the X-ray imaging systems.

A number of radiological and fluoroscopic imaging systems of various designs are known and are presently in use. Such systems generally are based upon generation of X-rays that are directed toward a subject of interest and attenuated, scattered or absorbed by the subject. The X-rays traverse the subject and impact a digital detector or an image intensifier. In medical contexts, for example, such systems may be used to visualize internal bones, tissues, and organs, and diagnose and treat patient ailments. In other contexts, parts, baggage, parcels, and other subjects may be imaged to assess their contents. In addition, radiological and fluoroscopic imaging systems may be used to identify the structural integrity of objects and for other purposes.

Such X-ray imaging systems may include anti-scatter grids for blocking the scattered X-rays from impacting the detector. An anti-scatter grid typically includes structures of radiation absorbing material (e.g., lead strips) to absorb scattered X-rays. However, such structures of radiation absorbing material also absorb primary X-rays, i.e., X-rays that travel in a straight line from the source to the detector, which may leave dark grid lines on a generated X-ray image. Such image artifacts are known as the grid line image artifacts. The grid line image artifacts may not only affect image quality, but also impair effective use of the images, such as for diagnosis in medical diagnostic contexts. There is a need, therefore, for improved approaches to use anti-scatter grids in a way that reduces the grid line image artifacts in X-ray images.

BRIEF DESCRIPTION

In accordance with a first embodiment, an imaging system includes a detector configured to detect X-rays from an X-ray source. The detector includes multiple photodetector elements. The imaging system also includes an anti-scatter grid disposed over the detector, wherein the anti-scatter grid includes multiple radiation absorbing elements. At least a portion of one or more of the radiation absorbing elements of the multiple radiation absorbing elements is disposed on each photodetector element, and a total area of each respective portion of the one or more radiation absorbing elements disposed on each photodetector element is substantially equal.

In accordance with a second embodiment, an imaging system includes a detector configured to detect X-rays from an X-ray source. The detector includes multiple photodetector elements having a pixel pitch p, wherein each photodetector element includes an axis along a length or width of the photodetector element. The imaging system also includes an anti-scatter grid disposed over the detector, wherein the anti-scatter grid includes multiple radiation absorbing elements. At least a portion of one or more of the radiation absorbing elements of the multiple radiation absorbing elements is disposed on each photodetector element, and a respective portion of the one or more radiation absorbing elements disposed on each respective photodetector element is disposed at an angle $\alpha$ relative to the axis.

In accordance with a third embodiment, a method for assembling an X-ray detector includes providing a detector configured to detect X-rays from an X-ray source, wherein the detector includes multiple photodetector elements having a pixel pitch p, wherein each photodetector element includes an axis along a length or width of the photodetector element. The method also includes disposing an anti-scatter grid over the detector at an angle $\alpha$, wherein the anti-scatter grid includes multiple radiation absorbing elements. At least a portion of one or more of the radiation absorbing elements of the plurality of radiation absorbing elements is disposed on each photodetector element, and a respective portion of the one or more radiation absorbing elements disposed on each respective photodetector element is disposed at the angle $\alpha$ relative to the axis.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

The present disclosure provides for systems and methods for utilizing an anti-scatter grid to reduce the grid line image artifacts in X-ray images. For example, a series of X-ray absorbing materials of the anti-scatter grid may be disposed at an angle relative to an axis along columns and/or rows of the photodetector elements of the detector to equally distribute among the photodetector elements the portions of the X-ray absorbing materials that cover each photodetector element. The techniques discussed below may be applied to various types of anti-scatter grids such as parallel anti-scatter grids, focused anti-scatter grids and so forth. In addition, the techniques described below may be utilized in a variety of radiographic imaging systems, such as computed tomography (CT) systems, fluoroscopic imaging systems, mammography systems, tomosynthesis imaging systems, conventional radiographic imaging systems and so forth. Further, it should be appreciated that the described techniques may also be used in non-medical contexts (such as security and screening systems and non-destructive detection systems).

Figure 1:
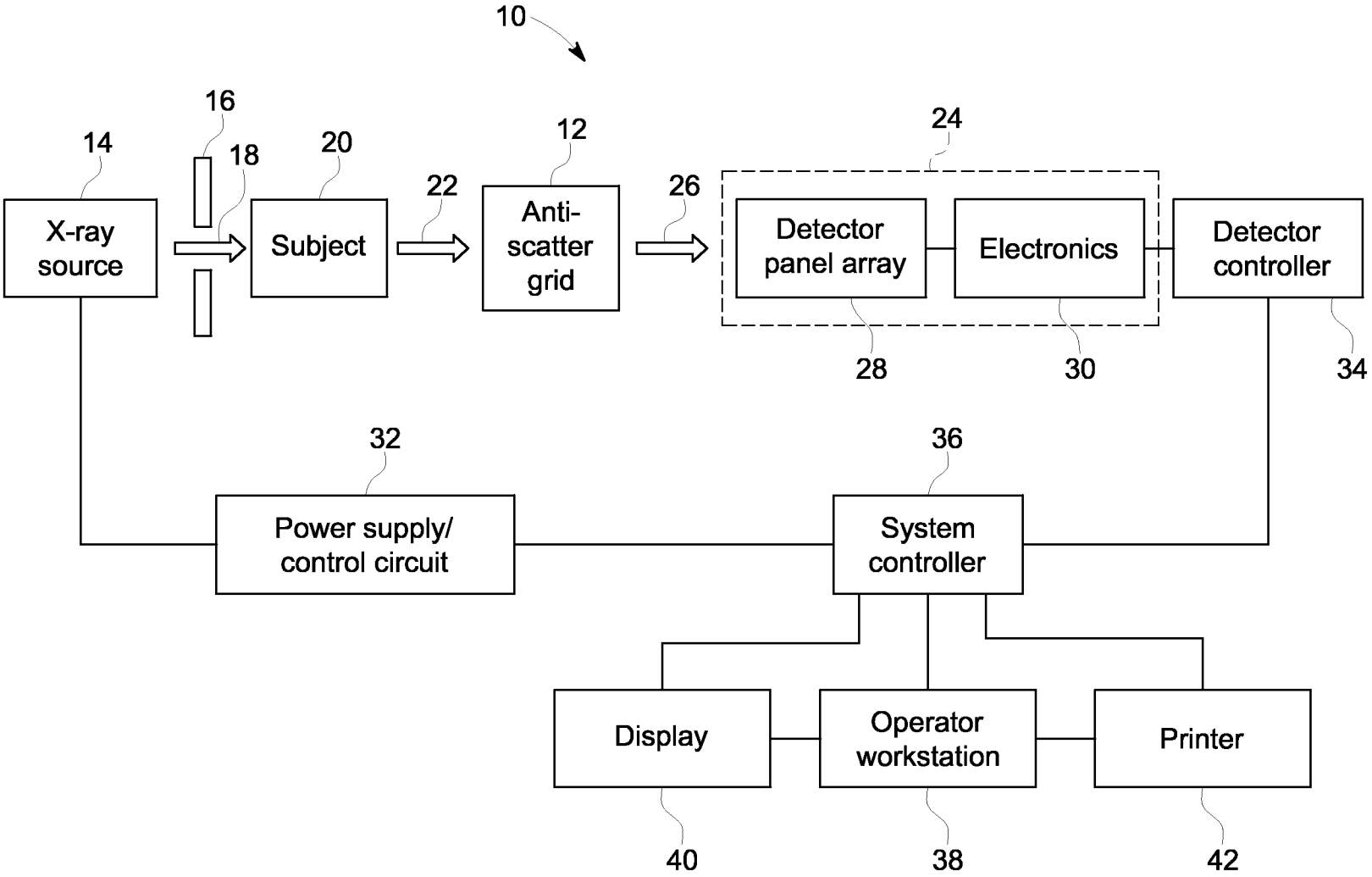
FIG. 1 is a block diagram of a digital X-ray imaging system illustrating an embodiment of the present disclosure.

Turning now to the drawings, FIG. 1 illustrates diagrammatically an X-ray imaging system 10 utilizing an anti-scatter grid 12. The X-ray imaging system 10 includes an X-ray source 14 positioned adjacent to a collimator 16. The collimator 16 permits an X-ray beam 18 to pass into a region in which a subject 20, such as a human patient, an animal, or an object, is positioned. A portion of the radiation 22 passes through or around the subject 20, where it may be attenuated and/or scattered by the subject 20. The anti-scatter grid 12 is positioned between the subject 20 and a detector 24. Another portion of the radiation (e.g., non-scattered X-rays 26) passes through the anti-scatter grid 12 and impacts the detector 24. The detector 24 may include a detector panel array 28, which coverts X-ray photons received on its surface to lower energy light photons, and subsequently to electric signals, which are acquired by electronics 30 and subsequently processed to reconstruct an image of the features of the subject 20. In certain embodiments, the detector 24 is a complementary metal-oxide-semiconductor (CMOS) based detector.

Scattering is a general process whereby some forms of radiation, such as X-rays, are forced to deviate from a straight trajectory by one or more localized non-uniformities in the medium through which it passes. The anti-scatter grid 12 reduces the effect of scattering by preventing scattered X-rays from reaching the detector 24. The anti-scatter grid 12 herein is further designed to reduce grid line image artifacts, as discussed below.

The X-ray source 14 is coupled to a power supply/control circuit 32, which furnishes power and commands X-ray emission for imaging examination sequences. Moreover, the detector 24 is communicatively coupled to a detector controller 34, which coordinates the control of the various detector functions. For example, the detector controller 34 may execute various signal processing and filtration functions, such as initial adjustment of dynamic ranges, and interleaving of digital image data.

Both the power supply/control circuit 32 and the detector controller 34 are responsive to signals from a system controller 36. In general, the system controller 36 commands operations of the imaging system 10 to execute examination protocols and to process acquired image data. The system controller 36 may include signal processing circuitry, which is typically based upon a programmed general purpose or application-specific digital computer; and associated manufactures, such as optical memory devices, magnetic memory devices, or solid-state memory devices, for storing programs and routines executed by a processor of the computer to carry out various functionalities, as well as for storing configuration parameters and image data. The system controller 36 may further include interface circuitry that permits an operator or user to define imaging sequences, determine the operational status and health of system components and so forth. The interface circuitry may also allow external devices to receive images and image data, command operation of the X-ray system 10, configure parameters of the X-ray system 10 and so forth.

The system controller 36 may be coupled to a range of external devices via a communications interface. Such devices may include, for example, an operator workstation 38 for interacting with the X-ray system 10, processing or reprocessing images, viewing images and so forth. Other external devices may include a display 40 or a printer 42. In general, these external devices 38, 40, 42 and similar devices may be local to the image acquisition components, or may be remote from these components, such as elsewhere within a medical facility, institution or hospital, or in an entirely different location, linked to the image acquisition system via one or more configurable networks, such as the Internet, intranet, virtual private networks and so forth.

In the embodiment illustrated in FIG. 1, the X-ray imaging system 10 may be a stationary system disposed in a fixed imaging room or a mobile system. The system 10 may also include a fixed or mobile c-arm system. The detector 24 may be portable or permanently mounted with respect to the system 10. The anti-scatter grid 12 is either permanently mounted together with the detector 24 to the system 10 or may be removable from the detector 24 and the system 10.

Figure 2:
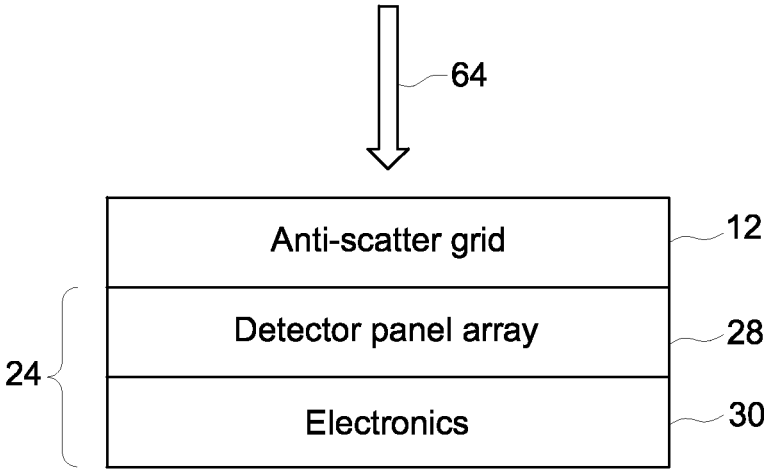
FIG. 2 is a schematic diagram of a side view of an anti-scatter grid with a detector in accordance with an embodiment of the present disclosure.

FIG. 2 illustrates schematically a side view of the anti-scatter grid 12 with the detector 24. The anti-scatter grid 12 may be mounted in contact with the detector 24, i.e., with no distance in between. In various other embodiments, the anti-scatter grid 12 may also be mounted together with the detector 24 with a distance in between (i.e., not in contact with the detector 24). The distance in between the anti-scatter grid 12 and the detector 24 may be fixed or adjustable depending on particular configurations and/or settings of the imaging system 10. Further, in one embodiment, the anti-scatter grid 12 is permanently mounted together with the detector 24. In another embodiment, the anti-scatter grid 12 is removable from the detector 24.

In the embodiment illustrated in FIG. 2, arrow 64 indicates the direction in which X-ray beams may pass through the anti-scatter grid 12 and impact the surface of the detector 24. The detector 24 includes the detector panel array 28 and the electronics 30. The detector panel array 28 may include a pixel array of photodetector elements (e.g., arranged in rows and columns), each of which may be a light sensing photodiode. The photodetector elements convert light photons to electrical signals. The detector panel array 28 may further include switching thin film field-effect transistors (FETs). In one embodiment, a scintillator material deposited over the pixel array of the photodetector elements and FETs converts incident X-ray radiation photons received on the scintillator material surface to lower energy light photons. Alternatively, the detector panel array 28 may convert the X-ray photons directly to electrical signals. Each photodetector element of the detector panel array 28 is also generally referred to as a "pixel" and typically in square shape. These photodetector elements are typically aligned adjacent with one another, forming an array of photodetector elements with rows and columns on the surface of the detector panel array 28. Each photodetector element has an axis along its length or width, i.e., along each row or column of the photodetector elements. The length or width of each photodetector element is generally referred to as the "pixel pitch" p. For example, in one embodiment, the detector 24 has a pixel pitch p of approximately 0.195 mm, which means there are approximately 5 pixels or photodetector elements per millimeter along the rows or columns of the detector panel array 28.

The electronics 30 convert analog electrical signals generated from the detector panel array 28 to digital values that can be processed to form a reconstructed image. In one embodiment, the detector 24 is a complementary metal-oxide-semiconductor (CMOS) based detector. In alternative embodiments, the techniques discussed herein may be applied to other types of digital detectors, such as amorphous silicon based detectors and so forth.

Figure 3:
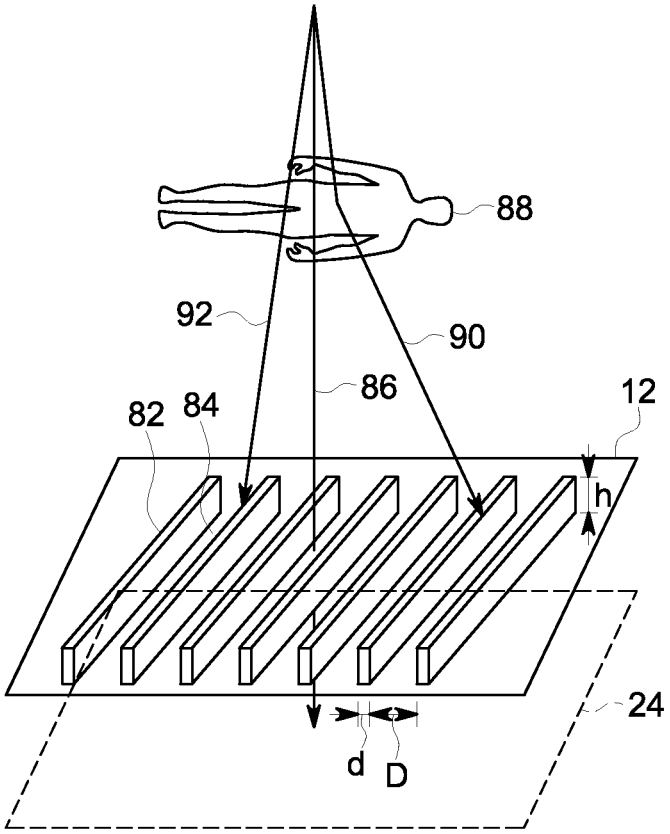
FIG. 3 is a perspective view of the anti-scatter grid of FIG. 2 in accordance with an embodiment of the present disclosure.

FIG. 3 shows a perspective view of the anti-scatter grid 12 disposed over the detector 24 in the imaging system 10. The anti-scatter grid 12 may comprise a series of spaced elements 82 (e.g., parallel strips), each of which comprises a radiation absorbing material such as lead, tantalum, uranium or alloys and mixtures or laminates of one or more of all of the foregoing metals. The anti-scatter grid 12 may further comprise spaces 84, which are provided between the radiation absorbing elements 82 and typically comprise a low-radiation absorbing material such as air, aluminum, foam, carbon fiber and the like. Such low-radiation absorbing spaces 84 are provided so as to allow an unscattered X-ray beam 86, i.e., a primary X-ray beam 86, to travel through the anti-scatter grid 12.

In the embodiment illustrated in FIG. 3, each radiation absorbing element 82 has a height h, a thickness d, and a distance D between an adjacent element 82. A grid pitch of the anti-scatter grid 12 is defined as the sum of the thickness d of each element 82 and the distance D between adjacent elements 82, i.e., d+D. A grid line rate of the anti-scatter grid 12 is the inverse of the grid pitch, i.e., 1/(d+D).

In the embodiment illustrated in FIG. 3, the anti-scatter grid 12 may be a parallel grid, wherein all of the radiation absorbing elements 82 are parallel to each other and perpendicular to the surface of the anti-scatter grid 12. The anti-scatter grid 12 may also be a focused grid, wherein the radiation absorbing elements 82 are progressively tilted such that straight lines extended from the points at which the elements 82 intersect with the surface of the anti-scatter grid 12 would intersect at a single point, i.e., focal point of the anti-scatter grid 12.

The unscattered radiation photons, such as those in the primary beam 86, which transmit through a subject 88, are typically the only photons that a user wants to detect on the detector 24 in order to obtain a true image of the subject 88. Scattered radiation photons, such as those in a scattered beam 90, are typically absorbed by the series of radiation absorbing elements 82 and are thereby blocked from detection by the detector 24. The scattered radiation photons do not represent a true image of the subject by virtue of their scattering. Some portions of the unscattered radiation photons, such as those in the primary beam 86, transmit through both the subject 88 and the anti-scatter grid 12 to the detector 24. However, some other portions of the unscattered radiation photons, such as those in X-ray beam 92, transmit through the subject 88 only to be obstructed from detection, typically by impinging on one of the radiation absorbing elements 82.

Therefore, the object of the anti-scatter grid 12 is to prevent or minimize scattered radiation photons, such as those in the beam 90, from being detected by the detector 24 and to enable as many unscattered radiation photons, such as those in the beams 86 and 92, to be detected as possible. However, as noted above, some portion of the unscattered radiation photons, such as those in the beam 92, are absorbed by the radiation absorbing elements 82 due to their physical thickness d. Consequently, if the photosensitive regions of some photodetector elements of the detector 24 are covered by more portions or a greater area of one or more radiation absorbing elements 82, grid line image artifacts may be present in the X-ray images.

In practice, particularly where the anti-scatter grid 12 is positioned in contact with, or close to the surface of the detector 24, the dimensions of the projection of the anti-scatter grid 12 on the surface of the detector 24 may be substantially the same as those of the actual anti-scatter grid 12 (e.g., the thickness d of each radiation absorbing element 82, and the distance D between the adjacent radiation absorbing elements 82), in which case the actual dimensions of the anti-scatter grid 12 may be convenient to use in the disclosed techniques as discussed in detail below.

Figure 4:
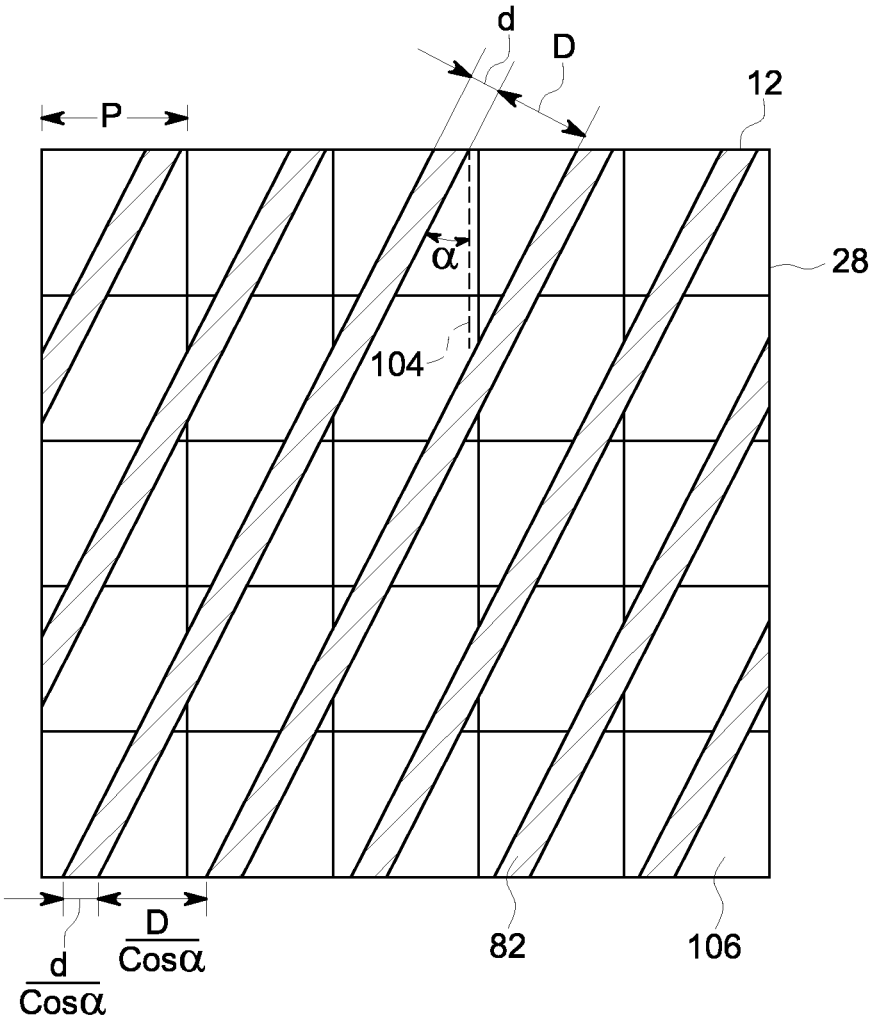
FIG. 4 is a top view of the anti-scatter grid of FIGS. 2 and 3 disposed over a detector panel array in accordance with an embodiment of the present disclosure.

FIG. 4 shows a top view of the anti-scatter grid 12 disposed over the X-ray detector panel array 28 of the detector 24. As illustrated, the anti-scatter grid 12 is rotated relative to an axis 104 along columns of photodetector elements 106 (or along the width of each photodetector element 106) of the detector panel array 28 to ensure that an equal area of radiation absorbing elements is disposed over each photodetector element 106. The disclosed techniques may also apply if the anti-scatter grid 12 is rotated relative to an axis along the rows of photodetector elements 106 (or along the length of each photodetector element 106) of the detector panel array 28. The anti-scatter grid 12 includes the series of radiation absorbing elements 82 as described above, each of which has the thickness d and is spaced-apart from the adjacent radiation absorbing element 82 with the distance D. The detector panel array 28 includes an array of photodetector elements 106 with a pixel pitch p. In the embodiment illustrated in FIG. 4, the pixel pitch p of the detector panel array 28 is greater than the grid pitch of the anti-scatter grid 12, i.e., p>d+D. The radiation absorbing elements 82 of the anti-scatter grid 12 are rotated with respect to the detector panel array 28 at an angle $\alpha$ relative to the axis 104. This results in a grid line rate in the horizontal direction of $$\frac{\cos\alpha}{d+D},$$

that is, a grid pitch in the horizontal direction of $$\frac{d+D}{\cos\alpha}.$$

To ensure an equal distribution of portions of the radiation absorbing elements 82 on each photodetector element 106, the angle $\alpha$ is chosen so that the grid pitch in the horizontal direction is equal to the pixel pitch p, i.e., $$\frac{d+D}{\cos\alpha} = p, \tag{1}$$

where the pixel pitch p of the detector panel array 28 is greater than the grid pitch of the anti-scatter grid 12, i.e., p>d+D. Resolving the Equation (1) yields $$\alpha = \cos^{-1}\left(\frac{d+D}{p}\right). \tag{2}$$

Again, because the pixel pitch p of the detector panel array 28 is greater than the grid pitch of the anti-scatter grid 12, i.e., p>d+D, the Equation (2) has a unique solution of $\alpha$ in the range of greater than approximately 0 degree and less than approximately 180 degrees. The angle $\alpha$ is specific to the design of the detector 24, such as the detector size, the pixel pitch and so forth. In the embodiment illustrated in FIG. 4, therefore, each photodetector element 106 of the detector panel array 28 is covered by the same area of the radiation absorbing elements 82, i.e., $$\frac{p \times d}{\cos\alpha}.$$

As such, X-ray radiation is attenuated equally for each photodetector element 82, and accordingly, the grid line image artifacts are minimized or reduced.

Generally, each photodetector element 106 includes photosensitive regions and non-photosensitive regions. The fill factor of each photodetector element 106 is the ratio of the area of the photosensitive regions to the total physical area of the photodetector element 106. It should be noted that while each photodetector element 106 is covered by the same area of the radiation absorbing elements 82 as illustrated in FIG. 4, different regions (e.g., photosensitive regions and non-photosensitive regions) of each photodetector element 106 may be covered by the radiation absorbing elements 82. Consequently, the area of photosensitive regions of each photodetector element 106 that are covered by the radiation absorbing elements 82 may not be the same among all of the photodetector elements 106. Thus, the fill factor may impact the performance of the disclosed techniques. However, such impact is generally very small because the fill factor of the detector 24 is generally great (i.e., close to 1). For example, in certain embodiments, the detector 24 is a complementary metal oxide semiconductor (CMOS) detector with a pixel pitch p of 80 μm and a fill factor of approximately 92%. The non-photosensitive area of each photodetector element 106 of the detector 24 is approximately 8%. Further, it is typical that less than ¼ of the non-photosensitive area is affected (i.e., covered) by the radiation absorbing elements 82. Thus, the impact of not equally covering the non-photosensitive regions (or photosensitive regions) of each photodetector element 106 of the detector 24 on the performance of the disclosed techniques is less than 2% in such embodiments. In various other embodiments, the detector 24, such as a CMOS based detector with a pixel pitch p of 135.3 μm or 195 μm, has a fill factor higher than approximately 92%. The impact of the non-photosensitive regions of such detector on the performance of the disclosed techniques would be even smaller.

Technical effects of the disclosed embodiments include providing the use of anti-scatter grids in the X-ray imaging system to minimize or reduce the grid line image artifacts. For example, the radiation absorbing elements of the anti-scatter grid may be positioned at an angle relative to the axis of each photodetector element of the detector panel array. As a result, the area of each photodetector element of the detector that is covered by the radiation absorbing elements of the anti-scatter grid is substantially equal. Therefore, the anti-scatter grid is utilized in the X-ray imaging system in such a way as to minimize or reduce the grid line image artifacts.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An imaging system comprising:

a detector configured to detect X-rays from an X-ray source and comprising a plurality of photodetector elements; and an anti-scatter grid disposed over the detector, wherein the anti-scatter grid comprises a plurality of radiation absorbing elements, at least a portion of one or more of the radiation absorbing elements of the plurality of radiation absorbing elements is disposed on each photodetector element, a total area of each respective portion of the one or more radiation absorbing elements disposed on each photodetector element is substantially equal, and each of the radiation absorbing elements is equally spaced apart relative to each other, wherein each photodetector element comprises a photosensing area, and at least some of the photosensing areas of the photodetector elements have different regions covered by the respective portion of the one or more radiation absorbing elements.

2. The imaging system of claim 1, wherein each of the photodetector elements comprise a substantially equal area.

3. The imaging system of claim 1, wherein the detector comprises a complementary metal-oxide semiconductor detector.

4. The imaging system of claim 1, wherein each of the radiation absorbing elements comprises a substantially equal width.

5. The imaging system of claim 1, wherein each photodetector element comprises an axis along a length or width of the photodetector element, and the respective portion of the one or more radiation absorbing elements disposed on each respective photodetector element is disposed at an angle relative to the axis, wherein the angle is greater than 0 degree and less than 180 degrees.

6. The imaging system of claim 5, wherein the plurality of photodetector element comprises a pixel pitch, and wherein a sum of a width of a single radiation absorbing element and a distance between adjacent radiation absorbing elements is less than the pixel pitch.

7. An imaging system comprising:

a detector configured to detect X-rays from an X-ray source and comprising a plurality of photodetector elements having a pixel pitch p, wherein each photodetector element comprises an axis along a length or width of the photodetector element; and an anti-scatter grid disposed over the detector, wherein the anti-scatter grid comprises a plurality of radiation absorbing elements, at least a portion of one or more of the radiation absorbing elements of the plurality of radiation absorbing elements is disposed on each photodetector element, and a respective portion of the one or more radiation absorbing elements disposed on each respective photodetector element is disposed at an angle $\alpha$ relative to the axis, wherein the angle $\alpha$ is greater than 0 degree and less than 180 degrees, and the angle $\alpha$ is the same for each respective portion of the one or more radiation absorbing elements disposed on each respective photodetector element.

8. The imaging system of claim 7, wherein a sum of a width, d, of a single radiation absorbing element and a distance, D, between adjacent absorbing elements is less than the pixel pitch, p.

9. The imaging system of claim 8, wherein the pixel pitch, p, equals $$\frac{d \times D}{\cos\alpha}.$$

10. The imaging system of claim 8, wherein an area of a respective portion of the one or more radiation absorbing elements disposed on each respective photodetector element is equal to $$\frac{p \times d}{\cos\alpha}.$$

11. The imaging system of claim 10, wherein the area of each respective portion of the one or more radiation absorbing elements disposed on each photodetector element is substantially equal.

12. The imaging system of claim 7, wherein each photodetector element comprises a photosensing area, and at least some of the photosensing areas of the photodetector elements have different regions covered by a respective portion of the one or more radiation absorbing elements.

13. The imaging system of claim 7, wherein each of the photodetector elements comprise a substantially equal area.

14. The imaging system of claim 7, wherein the detector comprises a complementary metal-oxide semiconductor detector.

15. The imaging system of claim 7, wherein each of the radiation absorbing elements comprises an equal width.

16. The imaging system of claim 7, wherein each of the radiation absorbing elements is equally spaced apart relative to each other.

17. A method for assembling an X-ray detector comprising:

providing a detector configured to detect X-rays from an X-ray source, wherein the detector comprises a plurality of photodetector elements having a pixel pitch p, wherein each photodetector element comprises an axis along a length or width of the photodetector element; and disposing an anti-scatter grid over the detector at an angle $\alpha$, wherein the anti-scatter grid comprises a plurality of radiation absorbing elements, at least a portion of one or more of the radiation absorbing elements of the plurality of radiation absorbing elements is disposed on each photodetector element, and a respective portion of the one or more radiation absorbing elements disposed on each respective photodetector element is disposed at the angle $\alpha$ relative to the axis, wherein the angle $\alpha$ is greater than 0 degree and less than 180 degrees, and the angle $\alpha$ is the same for each respective portion of the one or more radiation absorbing elements disposed on each respective photodetector element.

18. The method of claim 17, wherein a sum of a width, d, of a single radiation absorbing element and a distance, D, between adjacent absorbing elements is less than the pixel pitch, p.

19. The method of claim 18, wherein the pixel pitch, p, equals $$\frac{d \times D}{\cos\alpha}.$$

20. The method of claim 18, wherein an area of a respective portion of the one or more radiation absorbing elements disposed on each respective photodetector element is equal to $$\frac{p \times d}{\cos\alpha}.$$

21. The method of claim 17, wherein each photodetector element comprises a photosensing area, and at least some of the photosensing areas of the photodetector elements have different regions covered by a respective portion of the one or more radiation absorbing elements.

22. The method of claim 17, wherein each of the radiation absorbing elements comprises a substantially equal width.

23. The method of claim 17, wherein each of the radiation absorbing elements is equally spaced apart relative to each other.

* * * * *